US005551888A

United States Patent [19]

Rhodes, Sr.

[11] Patent Number: 5,551,888

[45] Date of Patent: Sep. 3, 1996

[54] SURFACE-PIERCING ELECTRICAL CONNECTOR PROTECTOR

[76] Inventor: Rockney J. Rhodes, Sr., 6 Storer Ct., Morganville, N.J. 07751

[21] Appl. No.: 383,303

[22] Filed: Feb. 3, 1995

[51] Int. Cl.[6] ..... H01R 13/62

[52] U.S. Cl. ..... 439/369; 439/367

[58] Field of Search ..... 439/367, 369, 439/368, 371, 527, 542

[56] References Cited

U.S. PATENT DOCUMENTS 4,449,015 5/1984 Hotchkiss et al. ..... 439/367
4,643,505 2/1987 House et al. ..... 439/367
5,135,409 8/1992 Thompson ..... 439/367
5,217,387 6/1993 Hull et al. ..... 439/369

*Primary Examiner*—Hien D. Vu

[57] ABSTRACT

A surface-piercing electrical connector protector including a rigid container having a hollow interior, an opening for allowing access to the interior for placing a pair of mated electrical plugs of a pair of electrical cords therein, and a pair of through holes formed on the container adjacent to the opening with each through hole sized for snugly receiving an electrical cord extended from one of the plugs in the container; a rigid lid securable over the opening of the container; and a cord securement mechanism coupled to the lid for holding an electrical cord extended from each through hole of the container in a fixed position.

2 Claims, 4 Drawing Sheets

SURFACE-PIERCING ELECTRICAL CONNECTOR PROTECTOR

BACKGROUND OF THE INVENTION

1. Field of the Invention

The present invention relates to a surface-piercing electrical connector protector and more particularly pertains to securing a pair of mated electrical plugs and associated electrical cords to a recipient surface, protecting the plugs from damage, and ensuring a proper electrical interconnection with a surface-piercing electrical connector protector.

2. Description of the Prior Art

The use of electrical connectors is known in the prior art. More specifically, electrical connectors heretofore devised and utilized for the purpose of ensuring proper interconnection of electrical plugs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,652,073 to Shaver et al. discloses an electrical connector with optional size cord opening and cover. U.S. Pat. No. 5,069,634 to Chiarolanzio discloses a snap lock extension cord and power tool connector. U.S. Pat. No. 5,158,479 to Mouissie discloses a connector with a fluid seal. U.S. Pat. No. 5,211,570 to Bitney discloses a cord connection system. U.S. Pat. No. 5,238,416 to Dickie discloses an extension cord receptacle.

While these devices fulfill their respective, particular objective and requirements, the aforementioned patents do not describe a surface-piercing electrical connector protector that fixedly secures a pair of mated electrical plugs and associated electrical cords to a recipient external surface, protects the plugs from damage such as from harsh environmental conditions, and ensures that a proper electrical interconnection of the plugs is maintained.

In this respect, the surface-piercing electrical connector protector according to the present invention substantially departs from the conventional concepts and designs of the prior art, and in doing so provides an apparatus primarily developed for the purpose of securing a pair of mated electrical plugs and associated electrical cords to a recipient surface, protecting the plugs from damage, and ensuring a proper electrical interconnection.

Therefore, it can be appreciated that there exists a continuing need for new and improved surface-piercing electrical connector protector which can be used for securing a pair of mated electrical plugs and associated electrical cords to a recipient surface, protecting the plugs from damage, and ensuring a proper electrical interconnection. In this regard, the present invention substantially fulfills this need.

SUMMARY OF THE INVENTION

In the view of the foregoing disadvantages inherent in the known types of electrical connectors now present in the prior art, the present invention provides an improved surface-piercing electrical connector protector. As such, the general purpose of the present invention, which will be described subsequently in greater detail, is to provide a new and improved surface-piercing electrical connector protector and method which has all the advantages of the prior art and none of the disadvantages.

To attain this, the present invention essentially comprises, in combination, a rigid plastic container. The container includes a rectangular planar horizontal bottom wall with an upper surface, a lower surface, and a periphery interconnecting the upper surface with the lower surface formed of a pair of long edges and a pair of short edges extended therebetween. The container includes a pair of opposed spaced rectangular planar vertical long walls and a pair of opposed spaced rectangular planar vertical short walls. Each long wall has an upper long edge, a lower long edge, and a pair of opposed side edges extended therebetween. Each short wall has an upper short edge, a lower short edge, and a pair of opposed side edges extended therebetween. The side edges of the long walls and the short walls are interconnected in an end-to-end configuration to define a sidewall having a rectangular cross section, an upper peripheral edge formed of the upper long edges with the upper short edges extended therebetween, and a lower peripheral edge formed of the lower long edges with the lower short edges extended therebetween. The lower peripheral edge of the sidewall is centered upon and integral with the upper surface of the bottom wall, thereby defining a hollow interior portion bounded by the sidewall and the bottom wall and further defining a ledge extended around the sidewall. Each short wall further includes a semicircular recess formed thereon at the midpoint of its upper short edge and a semicircular rubber seal secured to the short wall adjacent to the recess. One long wall of the container further includes a section of teeth projected outwards therefrom at a location near the midpoint of its associated upper long edge.

A rigid plastic lid is provided. The lid includes a pair of opposed spaced rectangular planar vertical long walls each having an upper long edge, a lower long edge, and a pair of opposed side edges extended therebetween. The lid includes a pair of opposed spaced rectangular planar vertical short walls each having an upper short edge, a lower short edge, and a pair of opposed side edges extended therebetween. The side edges of the long walls and the short walls are interconnected in an end-to-end configuration to define a border having a rectangular cross section, an upper peripheral edge formed of the upper long edges with the upper short edges extended therebetween, and a lower peripheral edge formed of the lower long edges with the lower short edges extended therebetween. The lower peripheral edge of the border further includes a peripheral lip with a L-shaped cross section projected outwards and downwards therefrom and a tongue extended downwards from the lip at the midpoint of a lower long edge. The lid further includes a rectangular planar horizontal top wall having a periphery integral with the upper peripheral edge of the border to define a hollow interior portion. Each short wall further includes a semicircular recess formed thereon at the midpoint of its lower short edge and a semicircular rubber seal secured to the short wall adjacent to the recess.

A rigid metal hinge is included and has a lower portion coupled to a long wall of the container. The lower portion is positioned at a location directly opposite the teeth on the other long wall of the container. The hinge has an upper portion coupled to a long wall of the lid. The upper portion is positioned at a location opposite the tongue on the other long wall of the lid. The hinge allows the lid to be opened for placing a pair of mated electrical plugs within the interior portion of the container. The opened container allows for positioning of each associated electrical cord of a plug within a separate recess of the container. The hinge further allows the lid to be closed with the recesses defining a pair of axially aligned through holes, the tongue to be snapidly secured to the section of teeth on the container to prevent access to the electrical plugs, and the seals to be held snugly in contact with the associated electrical cords.

Also provided is a pair of plastic arms. Each arm includes a generally semicircular cross section, an exterior surface, and an interior surface. Each arm also includes an inboard end integral with a short wall of the lid at a location directly above a separate recess, a downwardly projected outboard end, and an intermediate location defined between the inboard end and outboard end. A linear inboard section is extended from the inboard end to the intermediate location, and an arcuate outboard section extended from the intermediate location to the outboard end. Each arm is snapidly securable to an electrical cord extended from a through hole.

Lastly, a pair of spaced plastic stakes is included. Each stake has a base end integral with the lower surface of the bottom wall of the container. Each stake also has a pointed tip end projected downwards from the base end. The pair of stakes is adapted for piercing a recipient surface and thereby holding the container in a fixed horizontal position for use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved surface-piercing electrical connector protector which has all the advantages of the prior art electrical connectors and none of the disadvantages.

It is another object of the present invention to provide a new and improved surface-piercing electrical connector protector which may be easily and efficiently manufactured and marketed.

It is a further object of the present invention to provide a new and improved surface-piercing electrical connector protector which is of durable and reliable construction.

An even further object of the present invention is to provide a new and improved surface-piercing electrical connector protector which is susceptible of a low cost of manufacture with regard to both materials and labor, and which accordingly is then susceptible of low prices of sale to the consuming public, thereby making such a surface-piercing electrical connector protector economically available to the buying public.

Still yet another object of the present invention is to provide a new and improved surface-piercing electrical connector protector which provides in the apparatuses and methods of the prior art some of the advantages thereof, while simultaneously overcoming some of the disadvantages normally associated therewith.

Even still another object of the present invention is to provide a new and improved surface-piercing electrical connector protector for securing a pair of mated electrical plugs and associated electrical cords to a recipient surface, protecting the plugs from damage, and ensuring a proper electrical interconnection.

Lastly, it is an object of the present invention to provide a new and improved surface-piercing electrical connector protector comprising a rigid container having a hollow interior, an opening for allowing access to the interior for placing a pair of mated electrical plugs of a pair of electrical cords therein, and a pair of through holes formed on the container adjacent to the opening with each through hole sized for snugly receiving an electrical cord extended from one of the plugs; a rigid lid securable over the opening of the container; and cord securement means coupled to the lid for holding an electrical cord extended from each through hole of the container in a fixed position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description, makes reference to the annexed drawings wherein.

The same reference numerals refer to the same parts through the various Figures.

DESCRIPTION OF THE PREFERRED EMBODIMENT

Figure 1:
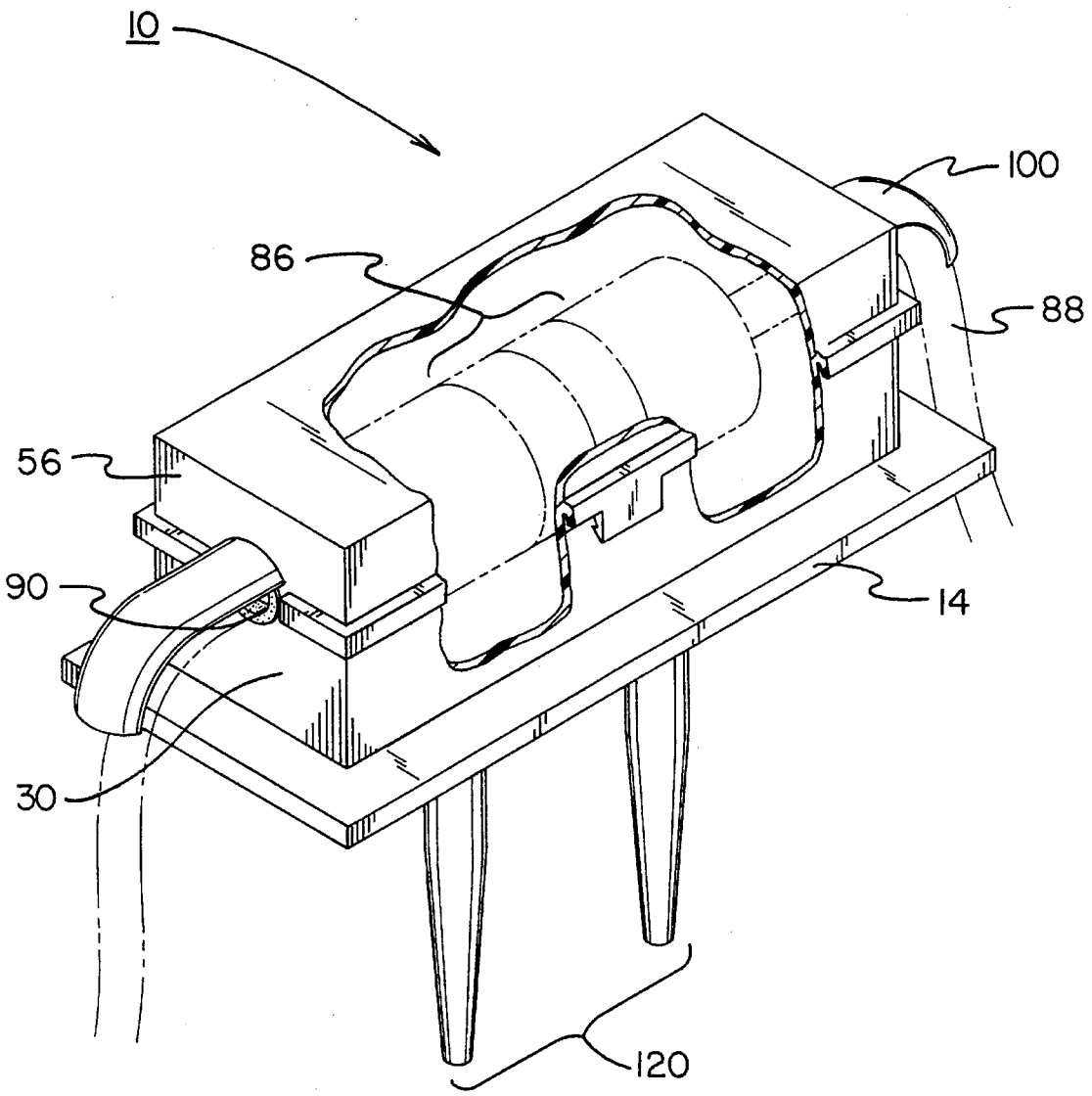
FIG. 1 is a sectional view of the preferred embodiment constructed in accordance with the principles of the present invention containing a pair of mated electrical plugs with a pair of associated electrical cords extended therefrom.
Figure 2:
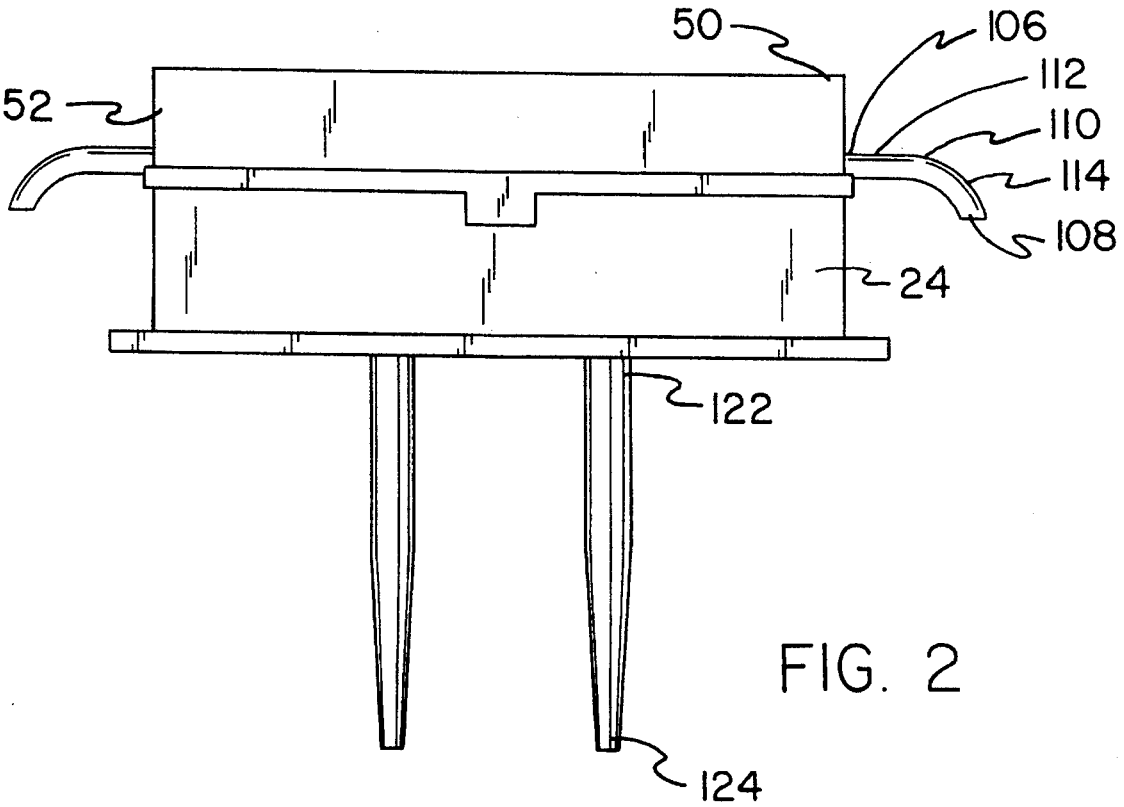
FIG. 2 is a side-elevational view of the preferred embodiment constructed in accordance with the principles of the present invention.
Figure 3:
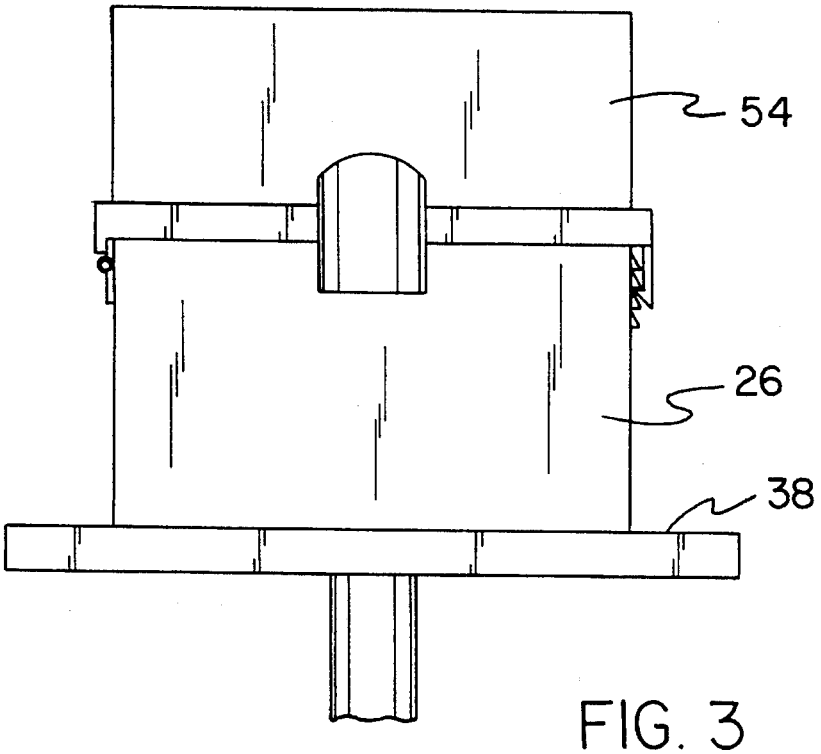
FIG. 3 is yet another side-elevational view of the present invention.
Figure 4:
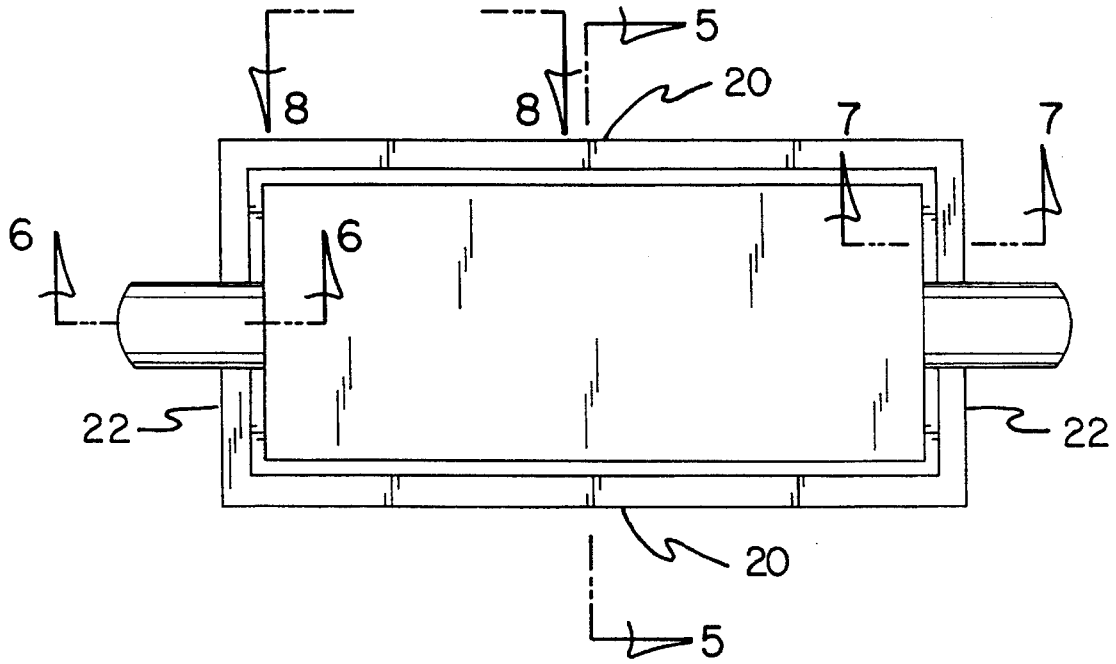
FIG. 4 is a plan view of the present invention with a pair of mated electrical cords disposed therein.
Figure 5:
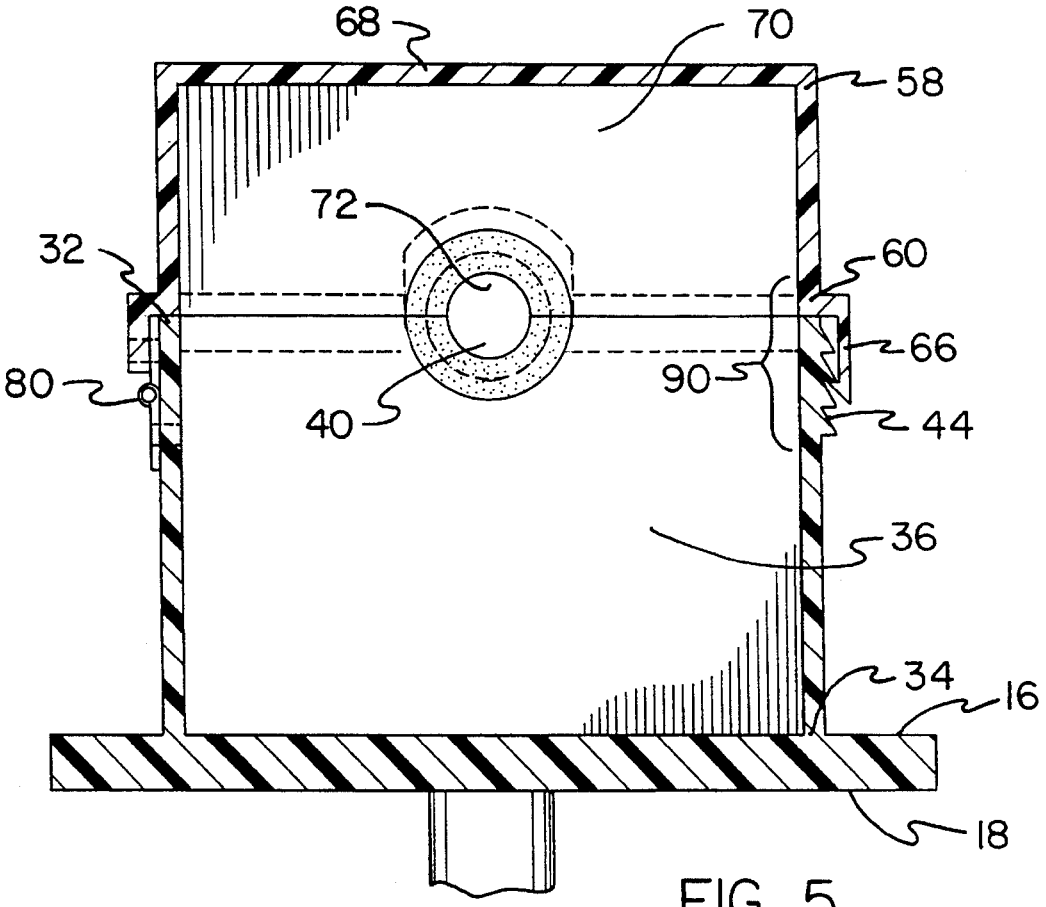
FIG. 5 is a cross-sectional view of the present invention taken along the line 5—5 of FIG. 4.
Figure 6:
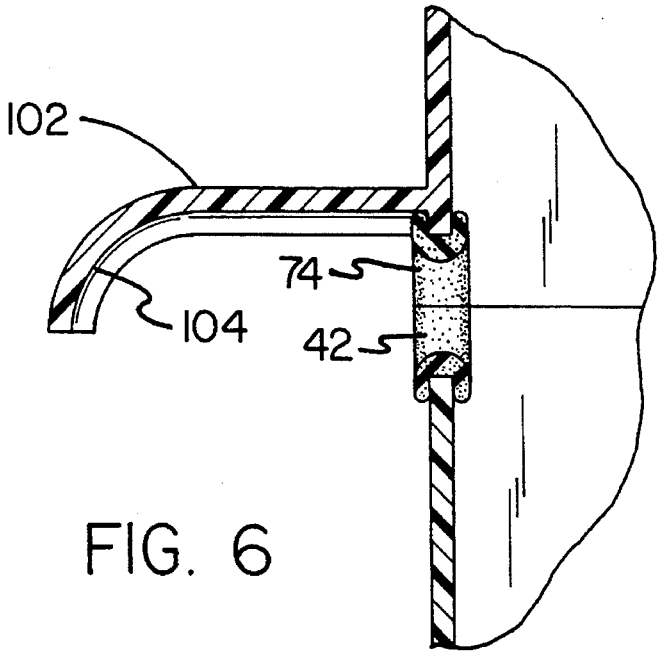
FIG. 6 is a cross-sectional view of the present invention taken along the line 6—6 of FIG 4.
Figure 7:
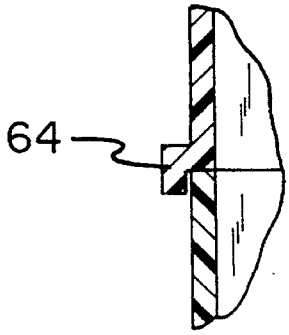
FIG. 7 a cross-sectional view of the present invention taken along the fine 7—7 of FIG. 4.
Figure 8:
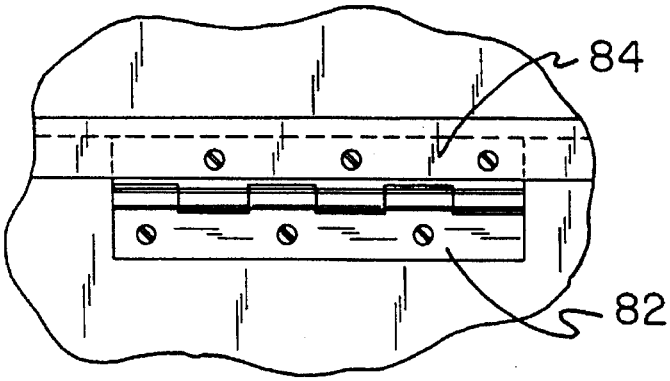
FIG. 8 is a view of the present invention taken along the line 8—8 of FIG. 4.

With reference now to the drawings, and in particular, to FIG. 1 thereof, the preferred embodiment of the new and improved surface-piercing electrical connector protector embodying the principles and concepts of the present invention and generally designated by the reference number 10 will be described.

The present invention is comprised of a plurality of components. In their broadest context, such components include a container, a lid, a pair of arms, and a pair of stakes. Such components are individually configured and correlated with respect to each other to provide the intended function of securing a pair of mated electrical plugs and associated electrical cords to a recipient surface, protecting the plugs from damage, and insuring a proper electrical interconnection.

Specifically, the present invention includes a container 12. The container is formed of a rigid impact-resistant plastic. The container includes a horizontal bottom wall 14. The bottom wall is rectangular and planar in structure. The bottom wall has an upper surface 16, a lower surface 18, and a periphery interconnecting the upper surface with the lower surface. The periphery is formed of a pair of long edges 20 and a pair of short edges 22 extended therebetween. The container further includes a pair of opposed and spaced long walls 24 and a pair of opposed and spaced short walls 26. Both the pair of long walls and the pair of short walls are rectangular and planar in structure and oriented in a vertical position. Each long wall has an upper long edge, a lower long edge, and a pair of opposed side edges extended therebetween. Each short wall has an upper short edge, a lower short edge, and a pair of opposed side edges extended therebetween. The side edges of the long walls and the short walls are interconnected in an end-to-end configuration to define a peripheral side wall 30. The side wall has a rectangular cross-section. The side wall also has an upper peripheral edge 32 formed of the upper long edges with the upper short edges extended therebetween and a lower peripheral edge 34 formed of the lower long edges with the lower short edges extended therebetween. The lower peripheral edge is centered upon and integral with the upper surface 16 of the bottom wall. The side wall extends perpendicularly upwards from the bottom wall 14. In this configuration, a hollow interior portion 36 is defined and bounded by the side wall 30 and the bottom wall 14. Furthermore, a ledge 38 is defined and extended around the side wall. The upper peripheral edge also defines a top opening for allowing access to the interior portion. Each short wall of the container further includes a semicircular recess 40 formed thereon at the midpoint of its upper short edge. A semicircular rubber seal 42 is snapidly secured to the short wall adjacent to a recess. One long wall of the container further includes a section of teeth 44 projected outwards therefrom at a location near the midpoint of its associated upper long edge. The teeth have a generally saw-tooth type cross section.

A lid 50 is also provided. The lid is formed of a rigid impact-resistant plastic. The lid includes a pair of opposed and spaced long walls 52. Each long wall is rectangular and planar in structure and oriented in a vertical position. Each long wall has an upper long edge, a lower long edge, and a pair of opposed side edges extended therebetween. Also included are a pair of opposed short walls 54. Each short wall is rectangular and planar in structure and oriented in a vertical position. Each short wall has an upper short edge, a lower short edge, and a pair of opposed side edges extended therebetween. The side edges of the long walls and the short walls are interconnected in an end-to-end configuration to define a border 56. The border has a rectangular cross-section. The border also has an upper peripheral edge 58 formed of the upper long edges with the upper short edges extended therebetween and a lower peripheral edge 60 formed of the lower long edges with the lower short edges extended therebetween. The lower peripheral edge further includes a peripheral lip 64 extended therearound. The lip has an essentially L-shaped vertical cross-section. The lip is projected outwards and downwards from the lower peripheral edge. Also included is a tongue 66. The tongue is integral with and extended downwards from the lip at the midpoint of a lower long edge. The tongue is terminated at a pointed tip end that is removably securable between a pair of teeth on the container. The lid also includes a rectangular planar horizontal top wall 68. The top wall has a periphery integral with the upper peripheral edge 58 of the border 56 to thereby define a hollow interior portion 70. The lower peripheral edge also defines a bottom opening for allowing access to the interior portion. Each short wall of the lid further includes a semicircular recess 72 formed thereon at the midpoint of its lower short edge. Also included is a pair of semicircular rubber seals 74 with each seal snapidly secured to a short wall adjacent to a recess.

To couple the lid to the container, a hinge 80 is provided. The hinge is formed of a rigid metal material. The hinge has a lower portion 82 coupled to a long wall of the container at a location directly opposite the teeth 44 on the other long wall of the container. The lid also has an upper portion 84 coupled to a long wall of the lid at a location opposite the tongue on the other long wall of the lid. The hinge allows the lid to be opened for placing a pair of mated electrical plugs 86 within the interior portion 36 of the container. In this open position, each associated electrical cord 88 of a plug is disposed within a separate recess 40 of the container such that the plugs are offset above the upper surface 16 of the bottom wall 14. The hinge further allows the lid to be closed with the recesses defining a pair of axially aligned through holes 90. Furthermore, the tongue is thereby snapidly secured to the section of teeth on the container to define a snap connector 92. In the closed position, the lid prevents access to the electrical plugs and thereby protects them from damage. In the closed position, the seals are held snugly in contact with an associated electrical cord disposed through one of the through holes 90, the seals thereby prevent communication of the interior portions of the container and the lid with the outside environment, thereby protecting the plugs from environmental corrosive damage caused by dust, rain, or the like.

To hold the electrical cords in a stationary position and thereby prevent a pair of mated electrical plugs in the closed container from inadvertently decoupling, a pair of arms 100 is included. The arms are formed of a plastic. Each arm has a generally semicircular cross-section, an exterior surface 102 and an interior surface 104. Each arm also has an inboard end 106 integral with a short wall 54 of the lid at a location directly above a separate recess 72. Each arm also has a downwardly projected outboard end 108 and an intermediate location 110 defined between the inboard end and outboard end. Also provided is a linear inboard section 112 extended from the inboard end to the intermediate location and an arcuate outboard section 114 extended from the intermediate location to the outboard end. Each arm is snapidly securable to an electrical cord 88 extended from a through hole. In this coupled configuration, the curved interior surface 108 of each is in contact with the surface of the electrical cord.

To secure the container in a fixed configuration, a pair of stakes 120 are included. Each stake is formed of a rigid impact-resistant plastic. Each stake has a base end 112 integral with the lower surface 18 of the bottom wall of the container. Each stake also has a pointed tip end 124 projected downwards from the base end. The pair of stakes is adapted for piercing a recipient surface such as the ground and thereby holding the container in a fixed horizontal position for use. Due to the elongated nature of the stakes, the height of the bottom wall can be raised above a recipient surface to preclude contact with external hazards such as water or snow.

The present invention is designed for use with electrical outlet cords. The present invention keeps an electrical connection from coming apart as well as preventing such connection from being exposed to adverse environmental conditions such as water, which could cause electrical shorting. In the preferred embodiment, the present invention consists of a container, a hinge, a lid, two arms, and one or two stakes. All components formed of a rigid impact-resistant plastic. The container is rectangular. A small recess for an electrical cord is located in each end of the container. One half of a snap lock is located on one side of the container and the other half is located on the lid. A lip also runs around the perimeter of the lid. Two small arms which curve down slightly extend out either end of the lid above the recess in the box. One or two 5/16 inch diameter stakes are attached to the bottom of the container. The present invention can be made in a variety of sizes and colors.

To operate the present invention, position the container over the ground by inserting the stakes into the soil. Connect the plugs of two electrical cords and open the container. Lay the cord connection inside the box, being careful to drop the cords into the recesses on the sides. This keeps the connection off of the bottom wall. Close the lid on the container so that the snap connector snaps shut. Snap the each electrical cord projected from the container within a separate arm. The lip around the edge of the lid and the seals around the through holes preclude water, snow, dust, and the like from entering the container. Once the plugs are sealed inside the container and the cords are fit within the arms, the connected plugs cannot be pulled apart.

In an alternate embodiment of the present invention, the stakes are not included. Thus, the alternate embodiment can be utilized in a portable-type configuration where the electrical interconnection is moved from one location to another. The present invention can be used on construction sites or outdoors when decorating homes and trees at Christmas. The present invention can also be utilized to maintain an electrical connection between two electrical extension cords or an electrical connection between an extension cord and a plug end of a power saw. It is extremely practical for use in any situation where two cords must be joined together and protected from damage, harsh environmental conditions, and inadvertent separation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A surface-piercing electrical connector protector for securing a pair of mated electrical plugs and associated electrical cords to a recipient surface, protecting the plugs from damage, and ensuring a proper electrical interconnection comprising, in combination:

a rigid plastic container including a rectangular planar horizontal bottom wall with an upper surface, a lower surface, and a periphery interconnecting the upper surface with the lower surface formed of a pair of long edges and a pair of short edges extended therebetween, the container further including a pair of opposed spaced rectangular planar vertical long walls and a pair of opposed spaced rectangular planar vertical short walls, each long wall having an upper long edge, a lower long edge, and a pair of opposed side edges extended therebetween, each short wall having an upper short edge, a lower short edge, and a pair of opposed side edges extended therebetween, the side edges of the long walls and the short walls interconnected in an end-to-end configuration to define a sidewall having a rectangular cross section, an upper peripheral edge formed-of the upper long edges with the upper short edges extended therebetween, and a lower peripheral edge formed of the lower long edges with the lower short edges extended therebetween, the lower peripheral edge centered upon and integral with the upper surface of the bottom wall thereby defining a hollow interior portion bounded by the sidewall and the bottom wall and further defining a ledge extended around the sidewall, each short wall further including a first semicircular recess formed thereon at the midpoint of its upper short edge and a semicircular rubber seal secured to the first semicircular recess, one long wall further including a section of teeth projected outwards therefrom at a location near the midpoint of its associated upper long edge;

a rigid plastic lid including a pair of opposed spaced rectangular planar vertical long walls each having an upper long edge, a lower long edge, and a pair of opposed side edges extended therebetween, a pair of opposed spaced rectangular planar vertical short walls each having an upper short edge, a lower short edge, and a pair of opposed side edges extended therebetween, the side edges of the long walls and the short walls interconnected in an end-to-end configuration to define a border having a rectangular cross section, an upper peripheral edge formed of the upper long edges with the upper short edges extended therebetween, and a lower peripheral edge formed of the lower long edges with the lower short edges extended therebetween, the lower peripheral edge further including a peripheral lip with a L-shaped cross section projected outwards and downwards therefrom and a tongue extended downwards from the lip at the midpoint of a lower long edge, the lid further including a rectangular planar horizontal top wall having a periphery integral with the upper peripheral edge of the border to define a hollow interior portion, each short wall further including a second semicircular recess formed thereon at the midpoint of its lower short edge and a semicircular rubber seal secured to said second semicircular recess;

a rigid metal hinge having a lower portion coupled to one of the long walls of the container at a location directly opposite the teeth on the container and an upper portion coupled to a long wall of the lid at location opposite the tongue on the other long wall of the lid, the hinge allowing the lid to be opened for placing a pair of mated electrical plugs within the interior portion of the container and for positioning each associated electrical cord of a plug within the first semicircular recess of the container, the hinge further allowing the lid to be closed with the recesses defining a pair of axially aligned through holes, the tongue to be snapidly secured to the section of teeth on the container to prevent access to the electrical plugs, and the seals to be held snugly in contact with the associated electrical cords;

a pair of plastic arms, each arm having a generally semicircular cross section, an exterior surface, an interior surface, an inboard end integral with a short wall of the lid at a location directly above the first and second semicircular recesses, a downwardly projected outboard end, an intermediate location defined between the inboard end and outboard end, a linear inboard section extended from the inboard end to the intermediate location, and an arcuate outboard section extended from the intermediate location to the outboard end, each arm snapidly securable to an electrical cord extended from a through hole; and a pair of spaced plastic stakes with each stake having a base end integral with the lower surface of the bottom wall of the container and a pointed tip end projected downwards therefrom, the pair of stakes adapted for piercing a recipient surface and thereby holding the container in a fixed horizontal position for use.

2. A surface-piercing electrical connector protector comprising:

a rigid container having a hollow interior, an opening for allowing access to the interior for placing a pair of mated electrical plugs of a pair of electrical cords therein, and a pair of through holes formed on the container adjacent to the opening with each of said through holes sized for snugly receiving one of said electric cords extended from one of the plugs;

a rigid lid securable over the opening of the container; and cord securement means coupled to the lid for holding an electrical cord extended from each through hole of the container in a fixed position wherein the cord securement means is formed of a pair of generally resilient arms, each of said arms having a generally semicircular cross section, an exterior surface, an interior surface, an inboard end integral formed with the lid at a location directly above one of said through holes on the container, a downwardly projected outboard end, an intermediate location defined between the inboard end and outboard end, a linear inboard section extended from the inboard end to the intermediate location, and an arcuate outboard section extended from the intermediate location to the outboard end, each of said arms snapidly securable to one of said electric cords extended from one of said through holes.

* * * * *